United States Patent [19]

Rowley

[11] 4,234,048

[45] Nov. 18, 1980

[54] DRILL BITS EMBODYING IMPREGNATED SEGMENTS

[75] Inventor: David S. Rowley, Salt Lake City, Utah

[73] Assignee: Christensen, Inc., Salt Lake City, Utah

[21] Appl. No.: 914,449

[22] Filed: Jun. 12, 1978

[51] Int. Cl.[3] ..... E21B 10/46

[52] U.S. Cl. ..... 175/329; 175/379; 175/404

[58] Field of Search ..... 175/329, 330, 409, 410, 175/411, 379, 404; 76/101 E, 108 A, DIG. 12

[56] References Cited

U.S. PATENT DOCUMENTS

| | | | |
|---|---|---|---|
| Re. 26,669 | 9/1969 | Henderson | 175/330 |
| 2,182,562 | 12/1939 | Koebel | 175/410 X |
| 2,511,991 | 6/1950 | Nussbaum | 175/330 |
| 3,100,543 | 8/1963 | Short | 175/330 |
| 3,106,973 | 10/1963 | Christensen | 175/330 X |
| 3,127,715 | 4/1964 | Christensen | 175/330 X |
| 3,158,458 | 10/1964 | Short | 175/329 |
| 3,537,538 | 11/1970 | Generoux | 175/379 X |
| 3,696,875 | 10/1972 | Cortes | 175/329 |
| 3,825,083 | 7/1974 | Flarity et al. | 175/329 X |
| 4,073,354 | 2/1978 | Rowley et al. | 175/410 X |
| 4,081,203 | 3/1978 | Fuller | 175/329 UX |
| 4,116,289 | 9/1978 | Feenstra | 175/329 |
| 4,128,136 | 12/1978 | Generoux | 175/330 |

FOREIGN PATENT DOCUMENTS

| | | | |
|---|---|---|---|
| 679193 | 12/1964 | Italy | 175/330 |
| 124993 | 5/1949 | Sweden | 175/410 |

*Primary Examiner*—James A. Leppink
*Assistant Examiner*—Richard E. Favreau
*Attorney, Agent, or Firm*—Subkow and Kriegel

[57] ABSTRACT

A diamond drill bit for drilling bore holes in earth formations having a body connectible to a drilling string, and provided with a matrix portion of hard metals in which diamonds are surface set at the outer gage portion and adjacent to the bit axis, the hard metal matrix having preformed grooves in which preformed diamond impregnated segments are inserted, which are a mixture of diamonds and hard metals, and secured to the matrix portion by brazing material. During bit rotation in the bore hole, the segments cut the major portion of the hole, the diamonds being dispersed throughout the mass of each segment for selective release from the segment as the diamonds become damaged and lost, thereby exposing new diamonds in the segment at a controlled rate, and thereby producing continual resharpening of the segments. As a result, the drilling rate of the bit is increased, as well as the length of hole drilled.

25 Claims, 9 Drawing Figures

DRILL BITS EMBODYING IMPREGNATED SEGMENTS

The present invention relates to drill bits, and more particularly to diamond drill bits used in the rotary drilling of bore holes in earth formations.

Certain earth formations are very hard and abrasive, resulting in drill bits having a short life, poor penetration rate, and necessitating the devotion of a large percentage of rig time in making round trips for the purpose of changing bits. Diamond drill bits, in which diamonds are surface-set in a bit matrix of hard metals, perform well in hard rock formations, but they are quickly damaged in very abrasive formations where accelerated wear on the diamonds occurs, as well as fracturing of the diamonds, the bit life being shortened considerably.

By virtue of the present invention, a diamond drill bit has been developed in which the penetration rates and length of bore hole drilled have been increased substantially. Diamond impregnated segments are secured to the hard metal matrix portion of the bit body, the segments operating upon the entire area of the bottom of the bore hole being drilled. These segments include diamonds dispersed throughout the mass of a matrix, which is designed to release the diamonds as they become damaged and expose new diamonds at a controlled rate, in effect resharpening the segment for continued drilling of the bore hole.

Surface set diamond drill bits of the prior art are not susceptible to repair after some of the diamonds become damaged or lost. Another objective of the present invention is to utilize impregnated segments for cutting members, because of their increased useful life, and secure such segments to the matrix portion of the bit body, also referred to as the "crown", in such manner that worn segments can be removed readily and replaced, all without disturbing the crown.

Heretofore, as disclosed in U.S. Pat. No. 3,696,875, separately prepared sintered segments containing diamonds have been utilized, which are placed in a carbon mold and the entire bit crown formed by a known infiltration process which requires a casting temperature usually of at least about 2150° F. With this method, the bit cannot be repaired after segments become worn. Moreover, synthetic diamonds cannot be utilized as the diamond portions of the segments, inasmuch as the sintering and casting temperatures cause thermal degradation of the synthetic diamonds.

By virtue of applicant's invention, the crown portion of the drill bit is first made with surface-set diamonds mounted at the inside diameter and along the outside diameter of a core bit to hold the inside and outside gage of the hole and core being drilled. In the case of a drill bit, the crown is first made with surface-set diamonds positioned at its outside diameter. In both cases, the crown can be formed by the infiltration method of the prior art which can occur at the normal casting temperature noted above of about 2150° F. The synthetic diamond impregnated segments are manufactured separately by a known hot pressing process, which enables the segments to be prepared at a much lower temperature than the infiltration temperature. As an example, the lower temperature may be about 1830° F. which is suitable for the manufacture of segments containing synthetic diamonds and does not lead to thermal degradation of the diamonds.

The mold used in forming the bit crown also has elements placed therein at precise locations, so that the casting and infiltrating operation also results in the crown having preformed grooves or slots in which the impregnated segments are placed, and then, by a brazing operation, affixed to the crown at a low temperature well below the temperature at which the synthetic diamonds would be thermally damaged. By way of example, the brazing process can be carried out at a temperature of approximately 1400° F. Although natural diamonds could be used in producing the impregnated segments, it is preferred to use synthetic diamonds since they have a longer drilling life than natural diamonds.

Because of the relatively low temperature at which the segments are affixed to the bit crown, worn or damaged segments can be readily replaced simply by elevating the temperature of the bit to the brazing temperature, which enables the individual segments to be removed and new or undamaged segments mounted in their place. Accordingly, the bit is susceptible of repair at substantial savings in bit cost.

During the drilling operation, the drilling fluid is pumped down through the string of drill pipe and discharges from the bit. The segments themselves are arranged on the bit crown and spaced from one another in such a manner as to provide fluid passages through which the drilling fluid can be forced under pressure for the purpose of removing the cuttings and enabling them to be carried along the exterior of the bit and string of drill pipe to the top of the bore hole, such drilling fluid also serving to keep the segments and other cutting elements of the bit in a clean and cool condition, thereby enhancing their useful lives.

This invention possesses many other advantages, and has other objects which may be made more clearly apparent from a consideration of several forms in which it may be embodied. Such forms are shown in the drawings accompanying and forming part of the present specification. These forms will now be described in detail for the purpose of illustrating the general principles of the invention; but it is to be understood that such detailed description is not to be taken in a limiting sense.

Referring to the drawings.

Figure 1:
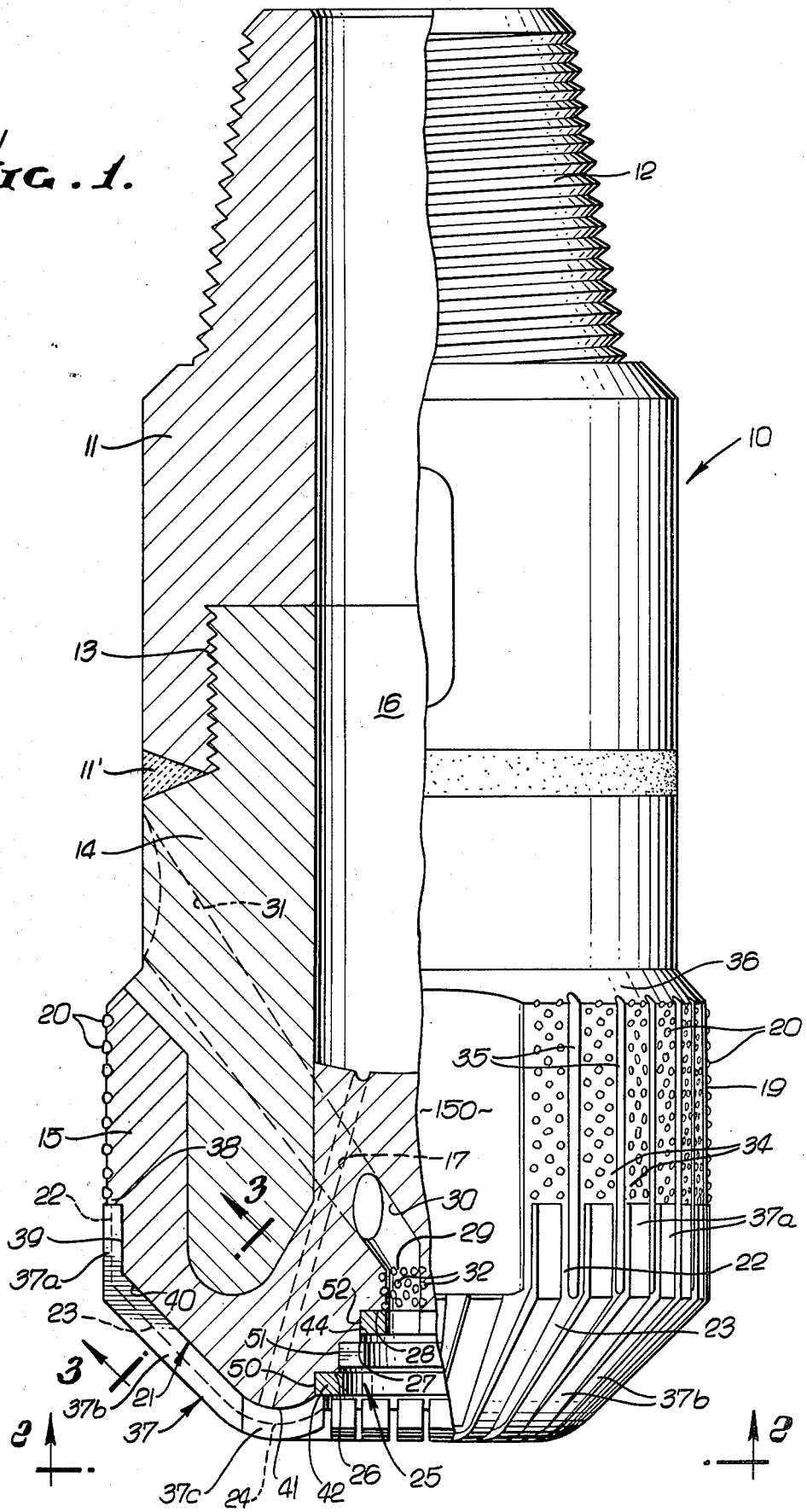
FIG. 1 is a combined side elevational view and longitudinal section through a diamond drill bit embodying the invention.
Figure 2:
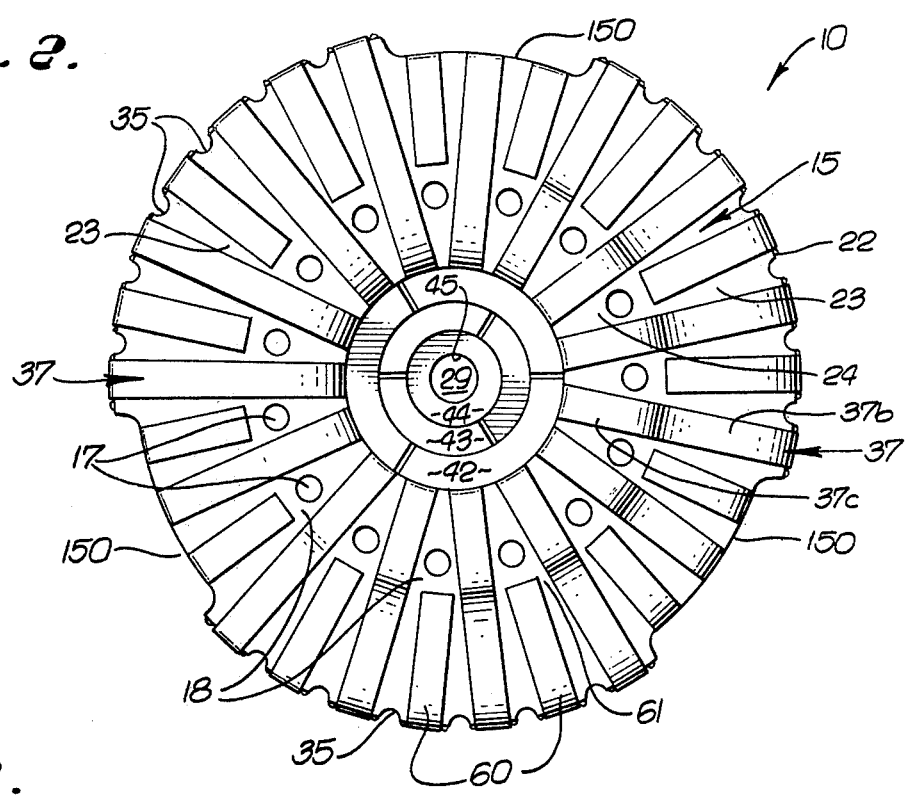
FIG. 2 is a bottom view of the drill bit shown in FIG. 1 taken along the line 2—2 of FIG. 1.
Figure 3:
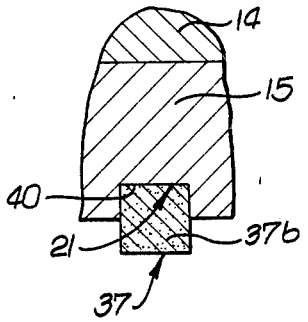
FIG. 3 is an enlarged fragmentary section taken along the line 3—3 of FIG. 1.

As disclosed in FIGS. 1 to 3, inclusive, a drill bit 10 is provided for operation upon the bottom of a bore hole, the cuttings being flushed from the bottom upwardly around the drill bit and string of drill pipe (not shown) to the top of the hole. The drill bit includes an upper body or blank 11 having an upper threaded pin 12 for threadedly attaching the bit to the string of drill pipe. The upper body is attached by a weld 11' and a threaded connection 13 to a lower body or shank 14, to which a matrix portion or crown 15 of a known type is secured. Circulating and drilling fluid pumped down through the drill pipe flows into a central or main passage 16 in the upper and lower body portions 11 and 14 of the tool, from where it will flow through a plurality of circumferentially spaced longitudinally extending ports or openings 17 extending through the bit crown for discharge against the bottom of the hole. The lower end of each distribution port 17 communicates with a generally radial fluid passage 18, referred to hereinbelow, extending toward the outer gage portion 19 of the bit.

The gage portion of the crown has diamonds 20, or similar cutting elements, secured in the outer gage face of the bit, which are secured to the crown 15 during the formation of the latter by the infiltration process. The crown has a plurality of generally radial slots or grooves 21 formed in its lower face during the production of the crown by the infiltration process, this face having an outside diameter or gage portion 22, the lower end of which terminates at a downwardly tapering conical portion 23 which, in turn, merges into a lowermost portion or nose 24. The nose merges into an upwardly tapering generally conical or stepped region 25, more specifically disclosed as a series of steps 26, 27, 28, the uppermost step 28 circumscribing a central core tube portion 29 into which a relatively small diameter core, formed by the bit, can move during the drilling of the hole. The core moves upwardly until it engages a tapered core breaker face 30 that will break off the core, enabling it to discharge through an ejection passage 31 extending laterally to the exterior of the drill bit above the reaming face 19. The central vertical passage has inner gage stones or diamonds 32 surface-set in the crown during the infiltration process for cutting the small diameter core (not shown) which will be broken off by the core breaker face 30, as described above. Outer gage diamonds 20 are surface-set in lands 34 defined by vertical fluid courses or passages 35 extending from the upper end of the outer conical portion 23 and opening upwardly through an upwardly tapering surface 36 of the crown and adjacent shank 14.

Preformed impregnated segments 37 are mounted in the grooves or slots 21 cast into the bit crown 15. Each segment may be made as a single piece, or a plurality of pieces. As shown, the upper portion **37*a* of each segment abuts a shoulder 38 at the end of a vertical groove portion 39. The flank or outer portion 37*b* of the impregnated segment is received within the downwardly tapering slot 40 preformed in the crown portion 15, its upper end being integral with the outer gage portion 37*a*, or, if made separate therefrom, abutting such gage portion. The lowermost or nose part 37*c* of each segment, which may be made integral with the flank 37*b*, or separately and abutting the lower end of the flank, is received in a companion curved groove portion 41** cast into the crown.

The nose portions **37*c* of the segments terminate substantially short of the axis of the bit, in the specific design illustrated, to allow space for the mounting of segmental or one-piece rings 42, 43, 44 in the crown which progressively decrease in diameter in an upward direction, and which bear against the companion steps or shoulders 26, 27, 28 formed in the crown or matrix portion. The inner portion of each ring partially overlies the outer portion of the next adjacent ring, the uppermost ring 44 having an opening 45 conforming to the core tube opening 29**. These rings are diamond impregnated cutters adapted to drill the central portion of the bore hole.

The impregnated segments and cutters are secured to the bit crown by brazing, the brazing material flowing along and coating the sides and inner surfaces of the grooves 21 and segments 37, the segments extending outwardly of the bit face to a substantial extent, which, for example, may be about one-half the depth of each segment. In a similar fashion, the impregnated rings 42, 43, 44 are brazed to the adjacent contacting surfaces of the bit crown.

As noted above, the slots or grooves 21 are preformed in the bit crown 15 during the infiltration step of the process, in which the outer gage diamonds 20 and the inner gage diamonds 32, both of which are natural diamonds, are affixed to and embedded partially in the crown. The steps 26, 27, 28 against which the impregnated rings 42, 43, 44 are to bear are also preformed in the crown during the infiltration process.

The segments and the impregnated rings are manufactured separately by a known hot-pressing method to precision dimensions, so as to appropriately fit within the slots or grooves 21 and against the steps 26, 27, 28, and the adjacent rises 50, 51, 52 with a precision fit. By use of the brazing process, the segments and the rings are then secured to the bit crown.

It is to be noted that the outer end of each flow passage 17 is disposed between and adjacent to the inner portions of a pair of segments 37. It is to be noted that, because of the diameter of the bit illustrated, additional segments 60 extend inwardly from the outer gage portion of the bit, but they extend inwardly only partially with respect to the other segments 37. This arrangement is provided to insure a sufficient number of segments for drilling the outer portions of the bore hole. Such additional segments may be unnecessary for the effective drilling of the inner portion of the bore hole by the longer segments.

The segments project outwardly of their respective slots and form fluid courses 61 through which the fluid discharging from the fluid passages 17 will be conducted toward the gage portion of the bit for the purpose of cleaning and cooling the segments and conveying the cuttings through the fluid courses 61 and then upwardly through the vertical fluid courses 35 extending between the gage portions of the segments. During the drilling operation, the central portion of the bore hole will be cut by the impregnated ring members 42, 43, 44, the small central core remaining passing through the uppermost ring 44 and past the inner gage stones 32 for engagement with the core breaker face 30 and discharge through the upwardly inclined lateral passage 31 to the exterior of the bit.

Figure 4:
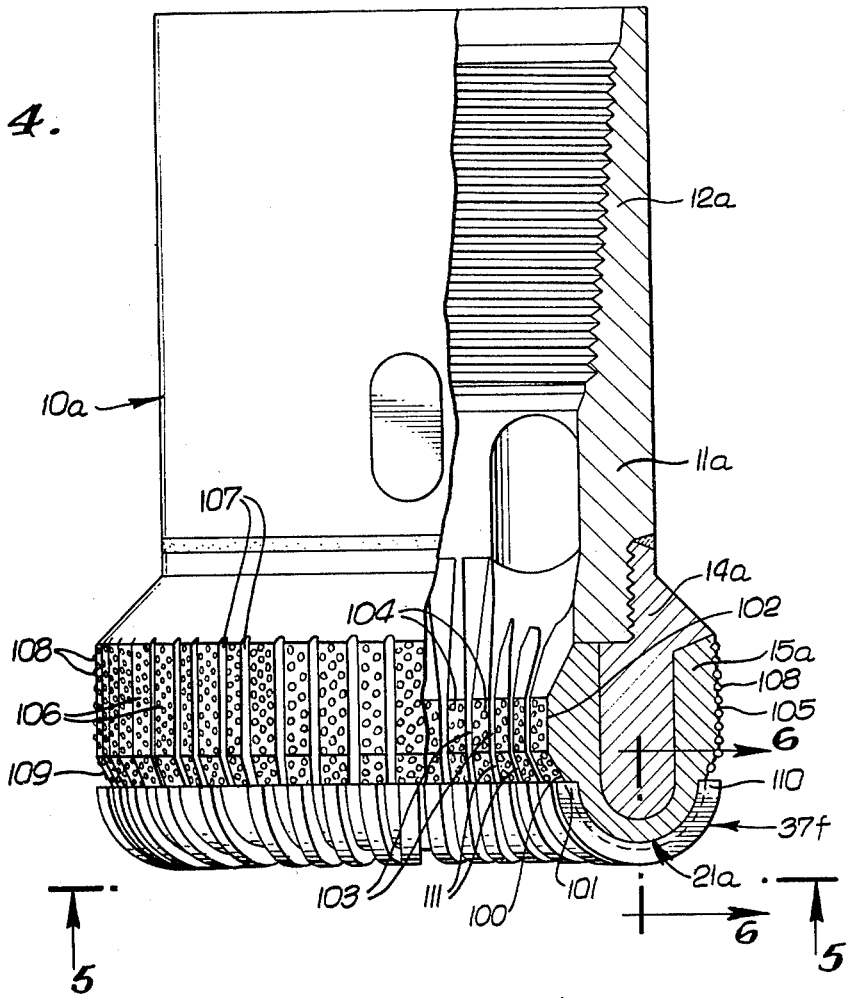
FIG. 4 is a combined side elevational view and longitudinal section through a core bit embodying the invention.

In the core bit embodiment **10*a* of the invention illustrated in FIG. 4, the upper body or blank 11*a* has a threaded box 12*a* for securing the bit to an outer core barrel of a coring apparatus (not shown) which is suitably secured to the lower end of a string of drill pipe (not shown), in a known manner. The lower end of the blank 11*a* is threadedly connected to a lower body or shank 14*a* around which a matrix body or crown 15*a* is formed. Diamond impregnated segments 37***f*, specifically disclosed as of an arcuate or semi-circular shape, are preformed and are mounted in companion generally radial preformed grooves 21*a* cast into the lower portion of the matrix body or crown. The inner portion of the crown has an upwardly tapering face 100 extending from a position above the inner ends 101 of the segments, this tapered face merging into an inner gage face 102. Inner fluid courses 103 divide the inner gage face into inner lands 104, the fluid courses continuing through the inner tapered face 100. Diamonds are surface-set in the lands in the tapered and gage faces.

Similarly, the outer gage face 105 of the crown is divided into lands 106 by vertical fluid courses 107, the lands receiving surface-set diamonds 108. The lower end of the outer gage face 105 terminates in a tapered surface 109 that ends at the outer upper end 110 of the segments 37*f* disposed in the grooves 21*a*, this inner tapered face also having fluid courses 111 that communicate with the fluid courses 112 provided between the segments 37*f* disposed in the slots or grooves. Similarly, the inner fluid courses 103 communicate with the fluid courses 112 provided by the spaced segments 37*f*.

During the coring operation, drilling fluid will pass through the space between the inner and outer core barrels (not shown), and through the inner fluid courses 103, discharging through the fluid courses 112 provided between the segments 37*f* and then passing upwardly through the fluid courses 107 in the outer gage portion of the bit, for continued upward movement around the outer core barrel and the string of drill pipe attached thereto. The cutting will be flushed through the several fluid courses, the fluid also cooling and cleaning the segments and the surface-set diamonds.

The core bit segments 37*f* are produced separately by hot-pressing, in essentially the same manner as the segments are produced for the drill bit. Such segments may embody synthetic diamonds, although natural diamonds can be used, if desired.

The segments 37*f* are secured in position within the grooves 21*a* by brazing, which can be performed at a temperature of about 1400° F.

Figure 7:
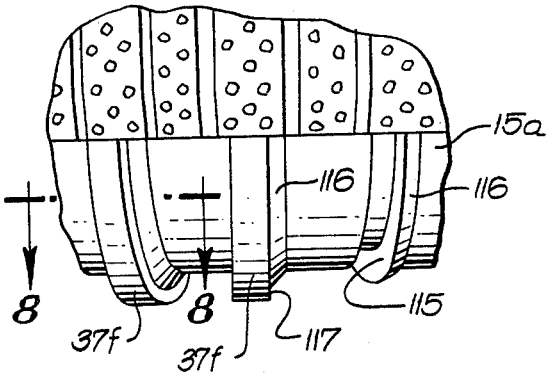
FIG. 7 is an enlarged side elevational view through a portion of the core bit disclosed in FIG. 4, one of the segments having been omitted to illustrate the groove or slot in which the segment is to be placed.
Figure 8:
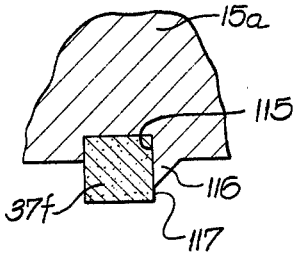
FIG. 8 is an enlarged fragmentary section taken along the line 8—8 on FIG. 7.

As shown in FIGS. 7 and 8, the trailing face 115 of each slot can be extended by forming the crown with a beveled flank 116 that bears against the trailing face 117 of the adjacent segment. This not only increases the area through which thrust is transmitted from the segment 37*a* to the crown 15*a*, but provides additional surface for the brazing material to secure each segment 37*a* to the crown 15*a*. In FIG. 7, one of the impregnated segments has been purposely omitted to disclose the large radial face 115 of the groove in which the segment is to be mounted.

Figure 9:
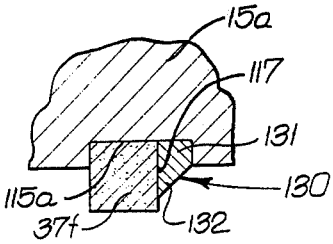
FIG. 9 is a view similar to FIG. 8 of another embodiment of the invention.
Figure 6:
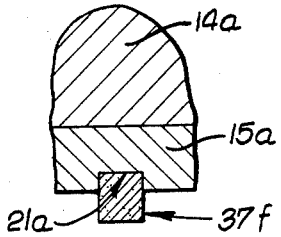
FIG. 6 is an enlarged fragmentary section taken along the line 6—6 on FIG. 4.
Figure 5:
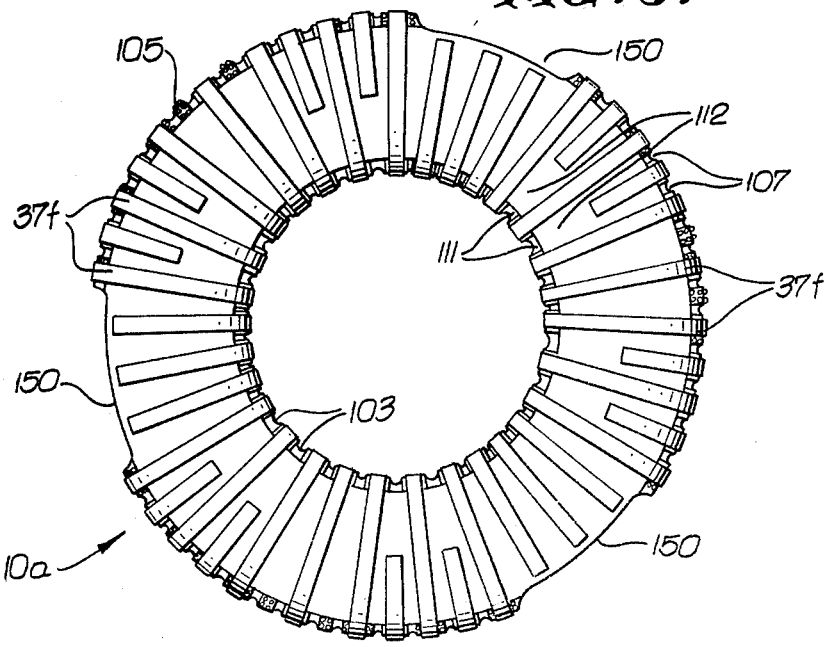
FIG. 5 is a bottom plan view taken along the line 5—5 on FIG. 4.

A variation of the beveled flank arrangement is disclosed in FIG. 9. Instead of the beveled flank 116 being formed integrally with the crown, as in FIG. 8, it can be formed as a separate tungsten carbide ring 130, the inner portion 131 of which is of rectangular cross-section, and the outer portion 132 of which is beveled or triangular in shape. The rectangular inner portion 131 fits within the trailing part of the wider grove 115*a* and the beveled outer portion 132 engages the trailing face 117 of the segment over a much greater extent than in the form illustrated in FIGS. 6 and 3, thereby backing up and offering greater support to the segment 37*f* than the arrangement disclosed in FIGS. 3 and 6. The separate tungsten carbide segment 130 is brazed into the slot 115*a* and to the segment 37*f* itself in the same operation as the segment is brazed to the base and leading side of the groove or slot and the trailing surface of the groove or slot.

A number of circumferentially spaced junk slots 150 are provided along the gage portion of the bits to enable the flushing fluid to carry relatively large cuttings upwardly along the bit to the smaller diameter shank portion thereabove, for continued upward movement around the drill pipe string to the top of the bore hole. Such junk slots are usually provided in diamond drill bits and do not constitute any portion of the present invention.

Bits made in accordance with the present invention have drilled very hard and very abrasive formation at a greater rate and of a longer longitudinal extent than surface-set drill bits. Preforming of the segments and their mounting in preformed slots or grooves in the crown, to which they are suitably secured, as by brazing or soldering, does not subject the diamonds to elevated temperatures, that have heretofore resulted in their deterioration, which is particularly true of synthetic diamonds used in the segments. The preformed segments are prepared at a lower temperature than the infiltration temperature at which the crown portion is made which is 2150° F. approximately, as compared with the lower temperature of 1830° F. for the segments. Moreover, the brazing process may be carried out at a temperature of approximately 1400° F., or well below the temperature at which synthetic diamonds will be damaged thermally.

Because of the low brazing temperature and the fact that the segments are separate cutting members, damage to or loss of segments does not require discarding of an entire drill bit. The damaged segments can be easily removed without any harmful effects on the remainder of the bit and replaced by new segments.

We claim:

1. A rotary bit for drilling bore holes in earth formations, comprising a body, a hard metal matrix secured to said body and providing a face adapted to confront the bottom portion of the bore hole, said matrix being fabricated at a temperature above about 2000° F., said matrix having preformed cavities therein opening through said face and produced during fabrication of said matrix, preformed diamond impregnated cutters in said cavities and projecting from said face to drill the bottom portion of the hole upon rotation of the bit, said cutters being fabricated at a temperature below about 1900° F., and means securing said preformed cutters to the walls of said preformed cavities.

2. A drill bit as defined in claim 1; the diamonds in said cutters being synthetic.

3. A drill bit as defined in claim 1; said securing means comprising brazing material affixing said cutters to the cavity walls.

4. A drill bit as defined in claim 3, each of said cutters comprising a mixture of diamonds and a hard metal bonded together.

5. A drill bit as defined in claims 3 or 4; said brazing material having a melting temperature not exceeding about 1400° F.

6. A drill bit as defined in claim 5, the diamonds in said cutters being synthetic.

7. A drill bit as defined in claim 1; and hard metal supports extending outwardly beyond said face in thrust transmitting relation to the trailing sides of said cutters.

8. A drill bit as defined in claim 7; said supports forming integral parts of said hard metal matrix.

9. A drill bit as defined in claim 7; said supports each being a separate member secured to said matrix.

10. A rotary drill bit for drilling bore holes in earth formations, comprising a body, a hard metal matrix secured to said body and providing a face adapted to confront the bottom portion of the bore hole, said matrix being fabricated at a temperature above about 2000° F., said matrix having generally radial preformed grooves therein opening through said face and extending to an outer gage portion of said matrix, preformed diamond impregnated cutter segments in said grooves extending to said outer gage portion and projecting from said face and its grooves to drill the bottom portion of the hole upon rotation of the bit, said segments being spaced from each other to provide lateral passageways between said segments opening at the inner ends of said segments and the outer ends of said segments, said cutter segments being fabricated at a temperature below about 1900° F., and means securing said cutter segments to the walls of said preformed grooves.

11. A drill bit as defined in claim 10; the diamonds in said cutter segments being synthetic.

12. A drill bit as defined in claim 10; and surface set diamonds in said outer gage portion of said matrix.

13. A drill bit as defined in claim 12; and surface set diamonds in said matrix adjacent to the axis of said bit.

14. A rotary drill bit as defined in claim 10; said securing means comprising brazing material affixing said cutter segments to the groove walls.

15. A drill bit as defined in claim 14; each of said cutter segments comprising a mixture of diamonds and a hard metal bonded together.

16. A drill bit as defined in claim 14 or 15; said brazing material having a melting temperature not exceeding about 1400° F.

17. A drill bit as defined in claim 16; the diamonds in said cutter segments being synthetic.

18. A rotary drill bit for drilling bore holes in earth formations, comprising a body, a hard metal matrix secured to said body and providing a face adapted to confront the bottom portion of the bore hole, said matrix being fabricated at a temperature above about 2000° F., said matrix having generally radial preformed grooves therein opening through said face and extending to an outer gage portion of said matrix, preformed diamond impregnated cutter segments in said grooves extending to said outer gage portion and projecting from said face to drill the bottom portion of the hole upon rotation of the bit, said cutter segments being fabricated at a temperature below about 1900° F., means securing said cutter segments to the walls of said preformed grooves, said segments being spaced from each other to provide fluid courses therebetween extending to said outer gage portion, said body having passage means therein, and means for conducting fluid from said passage means to said fluid courses to remove cuttings formed by said segments from the bottom region of the bore hole.

19. A rotary drill bit for drilling bore holes in earth formations, comprising a body, a hard metal matrix secured to said body and providing a face adapted to confront the bottom portion of the bore hole, said matrix being fabricated at a temperature above about 2000° F., said matrix having generally radial preformed grooves therein opening through said face and extending to an outer gage portion of said matrix, preformed diamond impregnated cutter segments in said grooves extending to said outer gage portion and projecting from said face to drill the bottom portion of the hole upon rotation of the bit, said cutter segments being fabricated at a temperature below about 1900° F., means securing said cutter segments to the walls of said preformed grooves, one or more preformed diamond impregnated rings at the central portion of said matrix, said matrix having one or more preformed surfaces against which said one or more rings bear, and means securing said one or more rings to said one or more surfaces.

20. A rotary drill bit for drilling bore holes in earth formations, comprising a body, a hard metal matrix secured to said body and providing a face adapted to confront the bottom portion of the bore hole, said matrix being fabricated at a temperature above about 2000° F., said matrix having generally radial preformed grooves therein opening through said face and extending to an outer gage portion of said matrix, preformed diamond impregnated cutter segments in said grooves extending to said outer gage portion and projecting from said face and its grooves to drill the bottom portion of the hole upon rotation of the bit, means securing said cutter segments to the walls of said preformed grooves, said preformed grooves extending to an inner gage portion of said matrix, the inner portions of said segments terminating at said inner gage portion, surface set diamonds in said inner gage portion, said segments being spaced from each other to provide lateral passageways between said segments opening at the inner ends of said segments and the outer ends of said segments.

21. A drill bit as defined in claims 20; and surface set diamonds in said outer gage portion of said matrix.

22. A rotary drill bit for drilling bore holes in earth formations, comprising a body, a hard metal matrix secured to said body and providing a face adapted to confront the bottom portion of the bore hole, said matrix having generally radial preformed grooves therein opening through said face and extending to an outer gage portion of said matrix, preformed diamond impregnated cutter segments in said grooves extending to said outer gage portion and projecting from said face to drill the bottom portion of the hole upon rotation of the bit, and means securing said cutter segments to the walls of said preformed grooves, said segments being spaced from each other to provide fluid courses therebetween extending to said outer gage portions, said body having passage means therein, and means for conducting fluid from said passage means to said fluid courses to remove cuttings formed by said segments from the bottom region of the bore hole, said preformed grooves extending to an inner gage portion of said matrix, the inner portions of said segments terminating at said inner gage portions, said conducting means including fluid passages in said inner gage portion leading to said fluid courses.

23. A drill bit as defined in claim 22; and surface set diamonds in said inner gage portion.

24. A rotary bit for drilling bore holes in earth formations, comprising a body, a hard metal matrix secured to said body and providing a face adapted to confront the bottom portion of the bore hole, said matrix having preformed cavities therein opening through said face, preformed diamond impregnated cutters in said cavities and projecting from said face to drill the bottom portion of the hole upon rotation of the bit, and means securing said preformed cutters to the walls of said preformed cavities, and hard metal supports extending outwardly beyond said face in thrust transmitting relation to the trailing sides of said cutters , said matrix having supplementary cavities continuing from said other cavities, said supports being separate members disposed in said supplementary cavities in thrust transmitting relation to the trailing sides of said cutters.

25. A drill bit as defined in claim 24; said securing means comprising brazing material affixing said cutters to the walls of said cavities and to said supports, and brazing material securing said supports to said matrix.

* * * * *